US009326617B2

(12) United States Patent
Hsu

(10) Patent No.: US 9,326,617 B2
(45) Date of Patent: May 3, 2016

(54) SPRING MATTRESS STRUCTURE

(71) Applicant: Han-Chung Hsu, Taipei (TW)

(72) Inventor: Han-Chung Hsu, Taipei (TW)

( * ) Notice: Subject to any disclaimer, the term of this patent is extended or adjusted under 35 U.S.C. 154(b) by 0 days.

(21) Appl. No.: 14/557,910

(22) Filed: Dec. 2, 2014

(65) Prior Publication Data

US 2015/0182030 A1 Jul. 2, 2015

Related U.S. Application Data

(63) Continuation-in-part of application No. 14/145,542, filed on Dec. 31, 2013, now Pat. No. 8,984,689.

(51) Int. Cl.
*A47C 23/04* (2006.01)
*A47C 23/05* (2006.01)
*A47C 23/043* (2006.01)

(52) U.S. Cl.
CPC ..... *A47C 23/0515* (2013.01); *A47C 23/0433* (2013.01)

(58) Field of Classification Search
CPC . A47C 27/07; A47C 23/0515; A47C 23/0433
USPC ..... 5/716–717, 723, 728, 739, 659; 24/437, 24/439–441, 298, 300, 455, 457, 481–482, 24/485, 530, 531, 547; 267/75, 136, 80, 267/90, 91, 95, 97, 100, 103, 104, 112
See application file for complete search history.

(56) References Cited

U.S. PATENT DOCUMENTS 1,725,187 A * 8/1929 Hager ..... A47C 27/07 24/265 A
1,748,666 A * 2/1930 Bednarek ..... A47C 27/07 5/259.1
1,755,805 A * 4/1930 Bayer ..... A47C 27/07 5/259.1
1,866,664 A * 7/1932 Munn ..... A47C 27/07 5/248
2,689,962 A * 9/1954 Hutcheson ..... A47C 23/0438 5/259.1
2,791,783 A * 5/1957 Rymland ..... A47C 27/07 5/275
2,820,970 A * 1/1958 Shapiro ..... A47C 27/07 267/91
2,942,278 A * 6/1960 Rymland ..... A47C 27/07 5/271
3,082,436 A * 3/1963 Rymland ..... A47C 27/07 29/423
3,457,572 A * 7/1969 Rymland ..... A47C 27/07 5/260
4,003,563 A * 1/1977 Taylor ..... F16F 1/122 267/100
4,781,360 A * 11/1988 Ramsey ..... A47C 27/07 267/91
4,790,038 A * 12/1988 Ikeda ..... A47C 27/065 267/91
6,050,553 A * 4/2000 Cable ..... A47C 27/07 267/91
6,684,436 B1 * 2/2004 Lovelace ..... A47C 27/07 5/716
7,934,277 B1 5/2011 Shu
8,375,492 B2 * 2/2013 Hsu ..... A47C 23/0435 5/690

* cited by examiner

*Primary Examiner* — David E Sosnowski
(74) *Attorney, Agent, or Firm* — WPAT, P.C., Intellectual Property Attorneys; Anthony King

(57) ABSTRACT

A spring mattress structure comprises a mattress body with a top bed surface and a bottom bed surface which consists of a plurality of shaft levers separated by a regular spacing between any two adjacent shaft levers and prepared for placement of a plurality of springs; each of the springs allows the bottom's both ends to be placed on surfaces of two adjacent shaft levers and develops a hollow space which correspond to a spacing developed by the two adjacent shaft levers; the bottom of each spring is fixed on one of the shaft levers with a spring-loaded locating piece so that the spring is securely connected to the shaft lever.

1 Claim, 7 Drawing Sheets

SPRING MATTRESS STRUCTURE

CROSS REFERENCE TO RELATED APPLICATION

This application is a Continuation-in-part of Ser. No. 14/145,542, filed Dec. 31, 2013, all of which is incorporated herein by reference.

BACKGROUND OF THE INVENTION

1. Field of the Invention

The present disclosure relates to a spring mattress structure, particularly a spring mattress structure which comprises shaft levers arranged as a bottom bed surface and fixing ends of springs for securely supporting the spring mattress structure with the springs.

2. Descriptions of the Related Art

The main structure of a pocket spring mattress is based on a plurality of spring sets fixed with outlines for development of a top bed surface and a bottom bed surface, each of which is covered by a cushion layer and wrapped by an external coating around a mattress.

The "mattress structure" (U.S. Pat. No. 7,934,277) submitted by the applicant on Sep. 8, 2010 (hereinafter referred to as the cited reference) has features as follow: "A mattress structure comprises a dead plate fixed in a mattress body, at least a first elastomer installed on the dead plate and comprising a hole at the bottom in which another elastomer is held, at least a second elastomer corresponding to the hole and installed on an active plate under the dead plate, at least one unit of lifting gear mounted on an undersurface of the active plate and driving the active plate to be shifted toward the dead plate and the second elastomers on the active plate to penetrate the holes as well as move upward for better elastic support of a mattress. As such, a mattress structure can be elastically adjusted with the second elastomers moving upward and downward."

Despite softness of a mattress structure in the cited reference adjustable, other issues such as a mattress structure assembled and moved easily and reduced in weight is solved in a spring mattress structure herein.

SUMMARY OF THE INVENTION

A spring mattress structure presents a plurality of shaft levers which constitute a bottom bed surface and are separated by a regular spacing between any two adjacent shaft levers wherein the spacing corresponds to each spring's hollow space and is freely accessed by a minor spring hung in the spring's hollow space.

A spring mattress structure comprises shaft levers arranged as a bottom bed surface and decreasing a spring bed's weight for easy movement.

A spring mattress structure depends on spring-loaded locating pieces to fix springs and shaft levers, securing bottoms of springs on the shaft levers.

A spring mattress structure comprises: a mattress body having a top bed surface as well as a bottom bed surface and accommodating a plurality of springs, each of which develops a hollow space and two opposite stress surfaces along a stretching direction, that is, a first stress surface and a second stress surface, wherein the first stress surface and the second stress surface on which a first placement end and a second placement end are designed get close to or contact the top bed surface and the bottom bed surface, respectively; a plurality of shaft levers securely arranged on the bottom bed surface of the mattress body for development of a spacing between any two adjacent shaft levers; a plurality of spring-loaded locating pieces, each of which is fixed on the shaft lever and allowing the first placement end and the second placement end on the spring's second stress surface to be securely fastened to surfaces of two adjacent shaft levers via spring fasteners, respectively; the hollow space in each of the springs is opposite to the spacing developed by two adjacent shaft levers.

In a preferred embodiment, the spring-loaded locating piece comprises a locating part, a first elastic fastener and a second elastic fastener extending from the locating part's both sides, fastening blocks at tops of the first elastic fastener and the second elastic fastener, and a clamping space between the first elastic fastener and the second elastic fastener; the bottom of the spring-loaded locating piece is fixed on a shaft lever on which the second stress surface of the spring is placed so that the first elastic fastener and the second elastic fastener face the top bed surface; the first placement end (the second placement end) on each spring's second stress surface is placed on one of two adjacent shaft levers so that the first placement end of one spring and the second placement end of the other spring occupy the clamping space developed by both the first elastic fastener and the second elastic fastener of the spring-loaded locating piece and the fastening block on the first elastic fastener and the other fastening block on the second elastic fastener are coupled with one spring coil and the other spring coil, respectively; as such, each of the springs can be fixed between two adjacent shaft levers and allows the hollow space to correspond to the spacing developed by the two adjacent shaft levers.

In a preferred embodiment, the first elastic fastener and the second elastic fastener of each spring-loaded locating piece obliquely extend and are opposite to each other.

In a preferred embodiment, a spacer block is installed between the first elastic fastener and the second elastic fastener of the spring-loaded locating piece and used in separating two springs for no entanglement in between.

In a preferred embodiment, the spring-loaded locating pieces are viscose by which the first placement end and the second placement end on one spring's second stress surface are directly stuck on surfaces of two adjacent shaft levers, respectively.

In a preferred embodiment, the spring-loaded locating pieces are C-shaped rings which are fixed on corresponding pinholes on the shaft levers so that the first placement end and the second placement end on one spring's second stress surface are coupled with two adjacent shaft levers, respectively.

In a preferred embodiment, the springs are exteriorly covered with one layer of external coating.

In a preferred embodiment, a minor spring is hung in each of the springs and freely activated through the spacing between two adjacent shaft levers.

In a preferred embodiment, the minor springs are exteriorly covered with one layer of external coating.

DETAILED DESCRIPTION OF THE PREFERRED EMBODIMENTS

The abovementioned and other detailed technical content, features and effects of a spring mattress structure are presented in preferred embodiments and accompanying drawings as follows.

Figure 1:
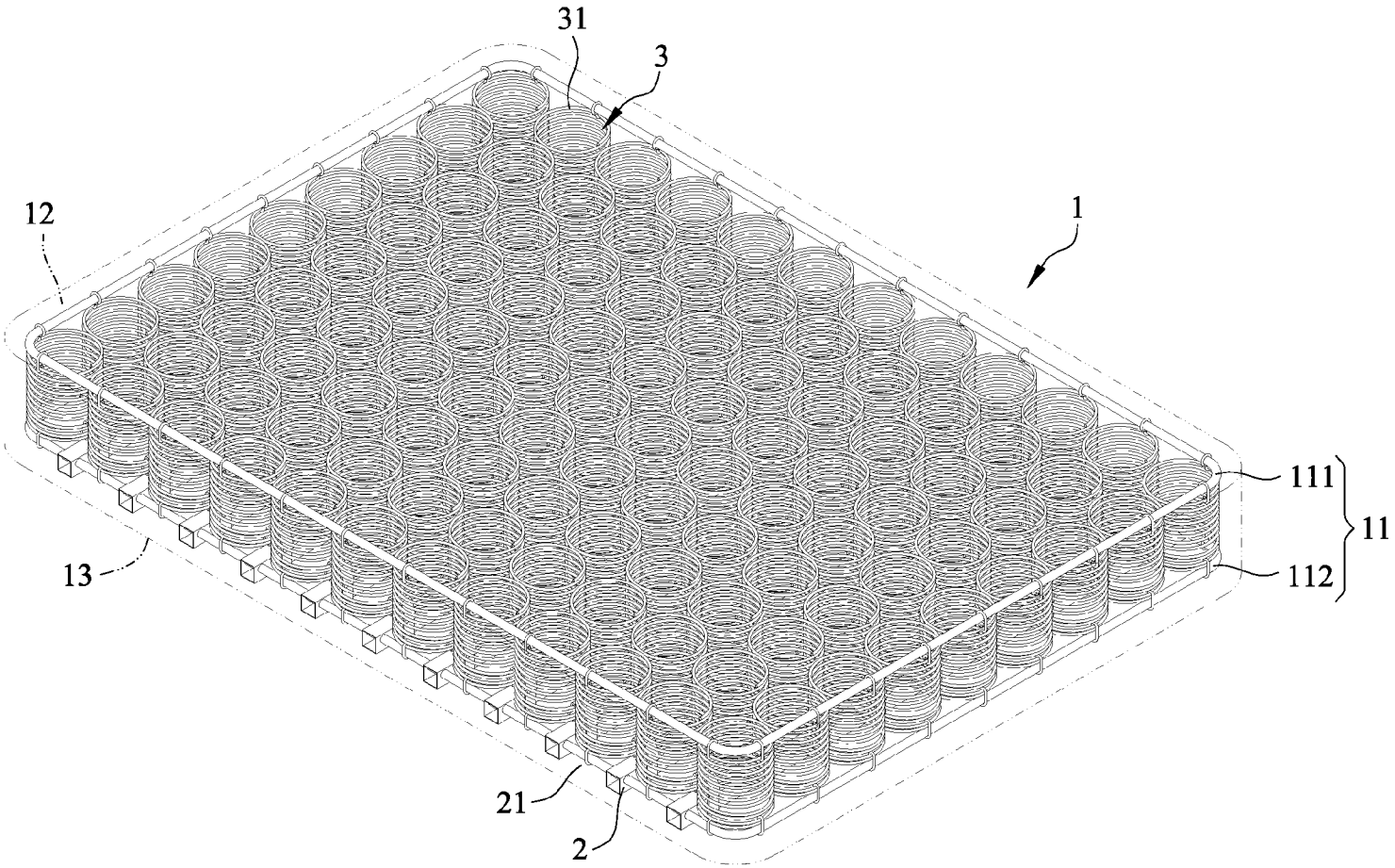
FIG. 1 is a perspective view of a spring mattress structure.
Figure 2:
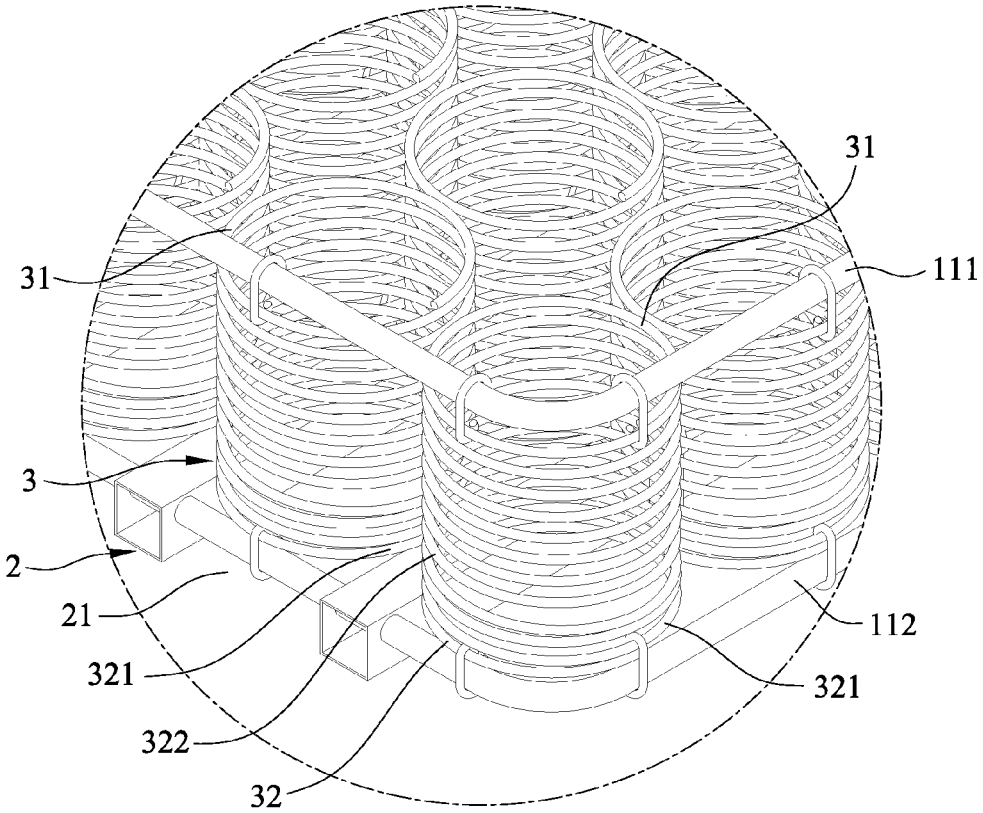
FIG. 2 is a partial enlargement view of a spring mattress structure.
Figure 3:
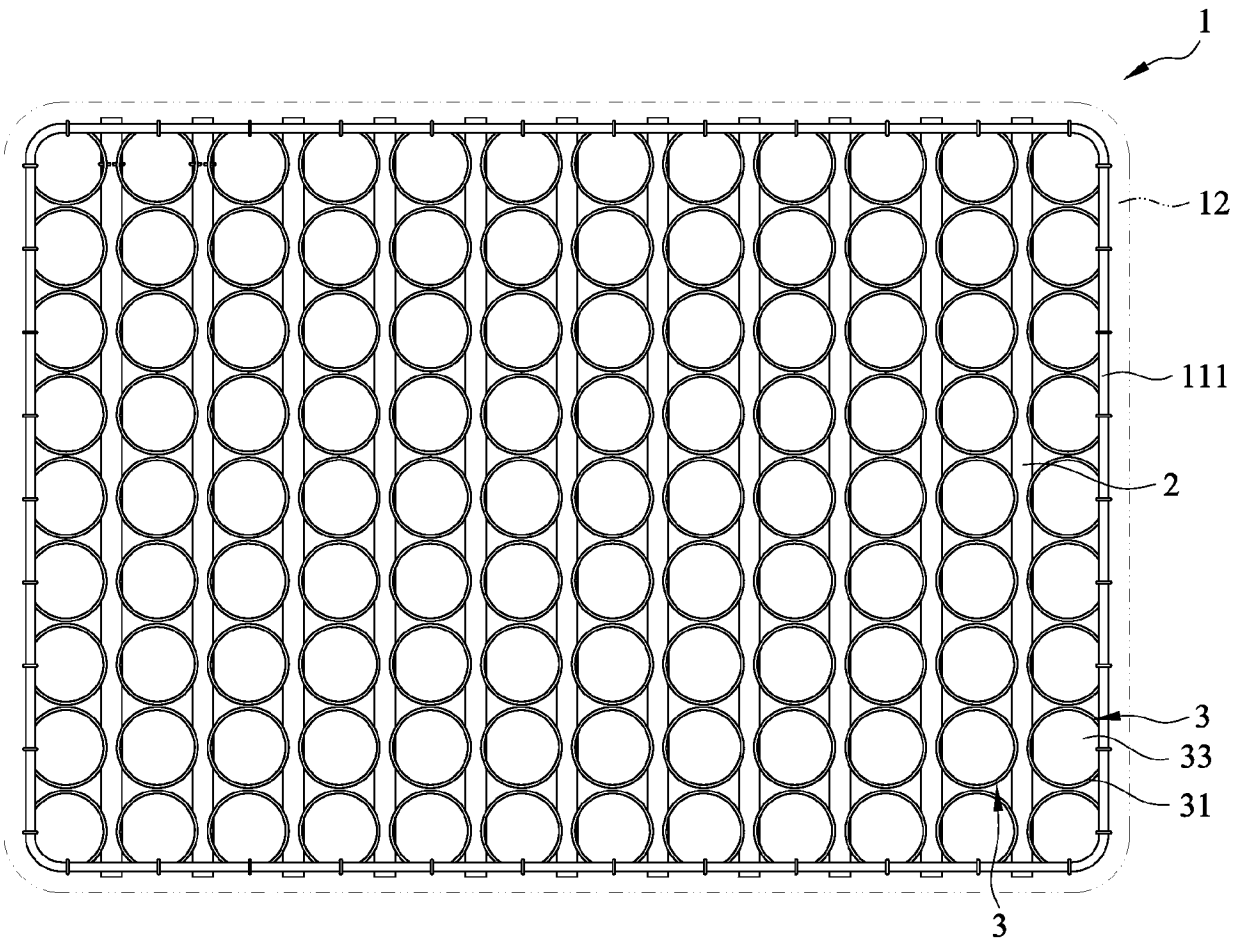
FIG. 3 is a top view of a spring mattress structure.

Referring to FIGS. 1, 2 and 3 which are a perspective view, a partial enlargement view and a plane view of a spring mattress structure, respectively. FIGS. 1, 2 and 3 illustrate a mattress body 1 comprising an outline body 11 with a top border 111 and a bottom border 112 for development of a top bed surface 12 and a bottom bed surface 13. The bottom bed surface 13 is developed with a plurality of shaft levers 2 separated by a regular spacing 21 between any two adjacent shaft levers 2; the shaft lever 2 allows its both ends to be fixed onto the bottom border 112 of the outline body 11 in which a plurality of springs 3 are installed; the spring 3 develops two opposite stress surfaces along a stretching direction, that is, a first stress surface 31 and a second stress surface 32, wherein the first stress surface 31 and the second stress surface 32 on which a first placement end 321 and a second placement end 322 are designed get close to or contact the top bed surface 12 and the bottom bed surface 13, respectively.

Figure 4:
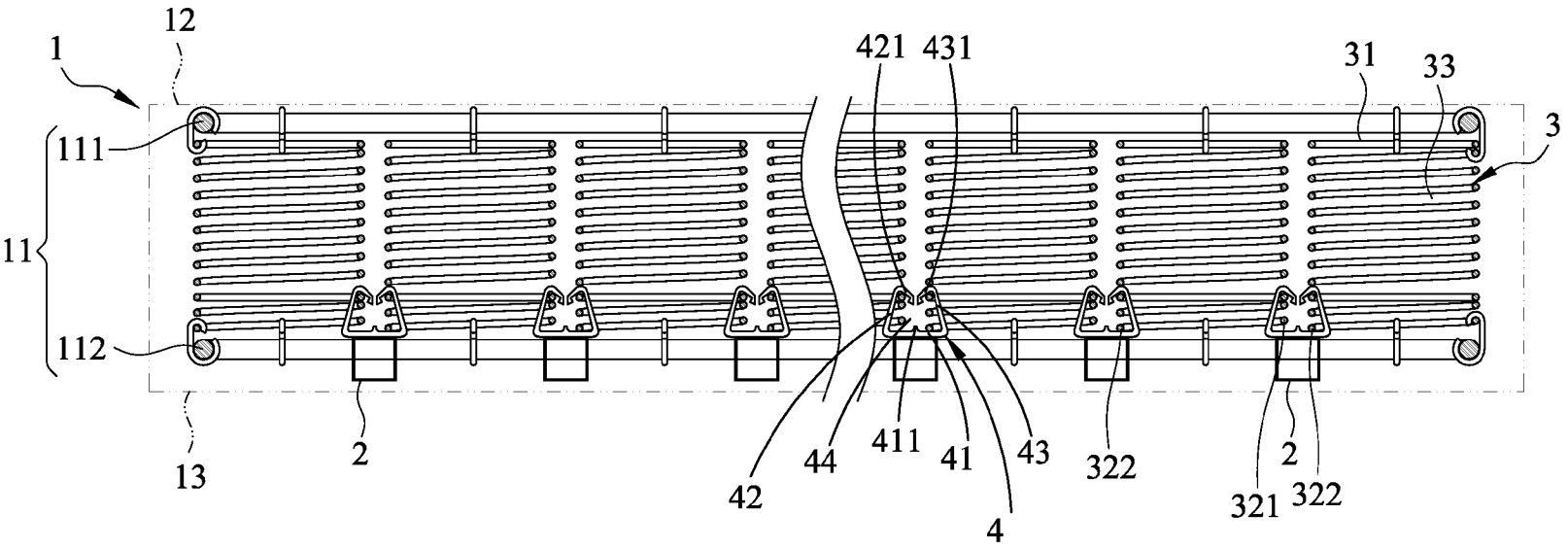
FIG. 4 is a sectional view illustrating spring-loaded locating pieces in a spring mattress structure.

Referring to FIG. 4 which illustrates a plurality of spring-loaded locating pieces 4 to be assembled are welded or stuck on surfaces of the shaft levers 2 and springs' second stress surfaces 32. Each of the spring-loaded locating pieces 4 comprises: a bottom 41; a first elastic fastener 42 and a second elastic fastener 43, both of which obliquely extend from both ends of the bottom 41 and are opposite to each other wherein the first elastic fastener 42 (second elastic fastener 43) is provided with a fastening block 421 (fastening block 431) at top for development of a clamping space 44 between the first elastic fastener 421 and the second elastic fastener 431; a spacer block 411 is located at the middle section of the bottom 41 and between the first elastic fastener 42 and the second elastic fastener 43.

The bottom 41 of the spring-loaded locating piece 4 is welded or stuck on one of the shaft levers 2 so that the spring-loaded locating piece 4 is fixed on the shaft lever 2; both the first elastic fastener 42 and the second elastic fastener 43 of the spring-loaded locating pieces 4 face the top bed surface 12.

Figure 7:
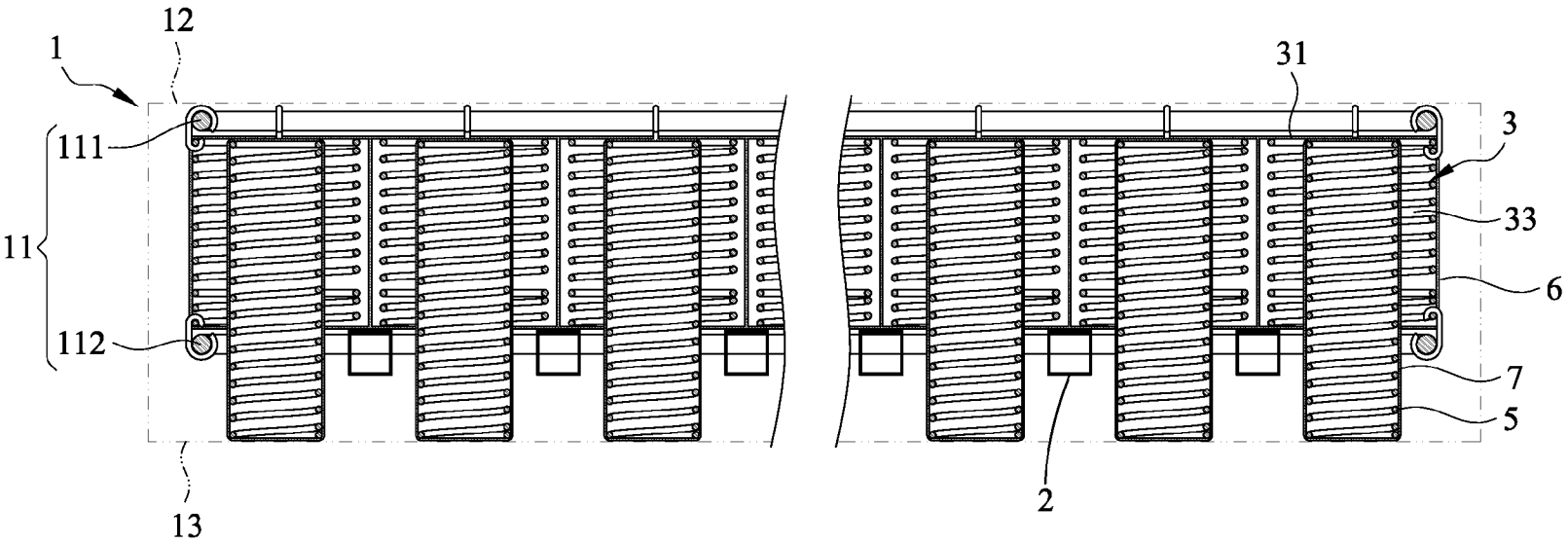
FIG. 7 is a schematic view illustrating minor springs installed in a spring mattress structure.

In each spring 3, the first placement end 321 and the second placement end 322 on the second stress surface 32 are positioned at two adjacent shaft levers 2 so that the first placement end 321 of one spring 3 and the second placement end 322 of the other spring 3 occupy the clamping space 44 developed by the first elastic fastener 42 and the second elastic fastener 43 of the spring-loaded locating piece 4 and are separated by the spacer block 411 for no entanglement of any two springs 3. Moreover, each spring 3 is fixed on two adjacent shaft levers 2 and makes its hollow space 33 correspond to the spacing 21 developed by the two adjacent shaft levers 2 when the fastening block 421 of the first elastic fastener 42 and the fastening block 431 of the second elastic fastener 43 clamp the spring coil of one spring 3 and the spring coil of the other spring 3, respectively. As shown in FIG. 7, each of minor springs 5 hung in the hollow spaces 33 of the springs 3 is freely activated through the spacing 21 between two adjacent shaft levers 2.

Figure 5:
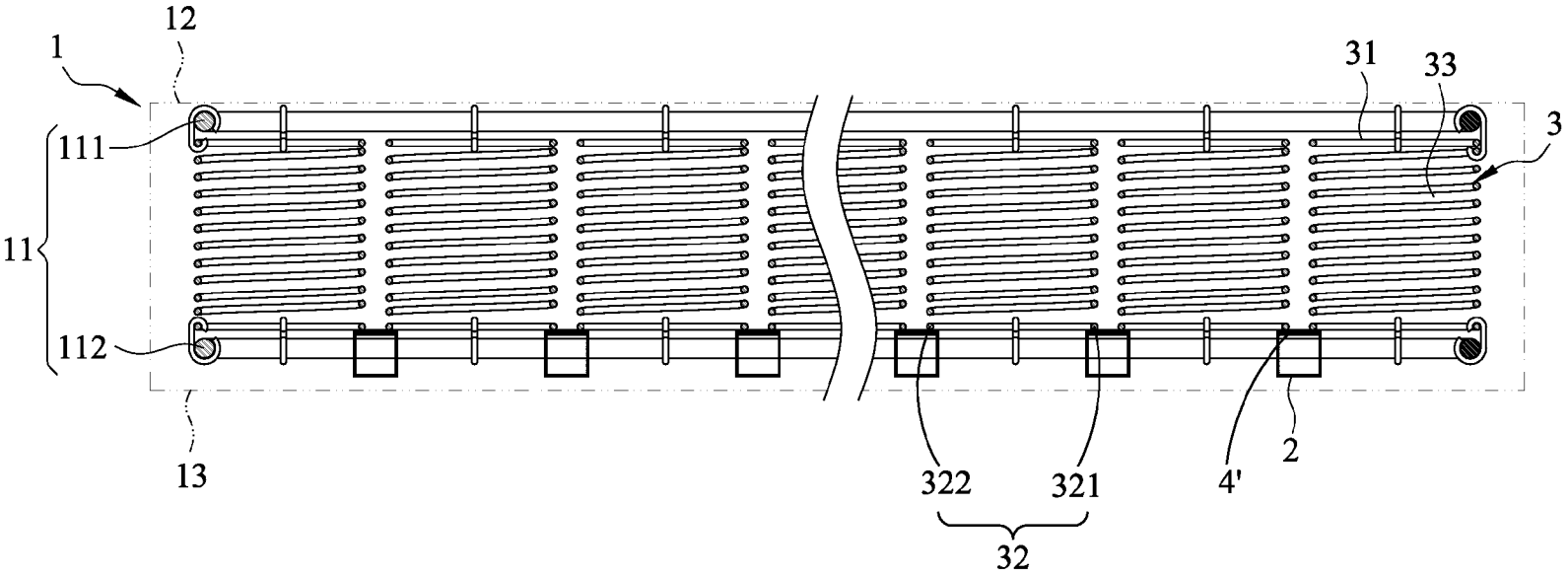
FIG. 5 is a sectional view illustrating spring-loaded locating pieces in a spring mattress structure.

Referring to FIG. 5 which is a schematic view illustrating spring-loaded locating pieces in another embodiment wherein the spring-loaded locating pieces 4' are viscose by which both the first placement end 321 and the second placement end 322 of the spring 3 are directly stuck on surfaces of two adjacent shaft levers 2 and the second stress surface 32 of the spring 3 is fixed on surfaces of the shaft levers 2.

Figure 6:
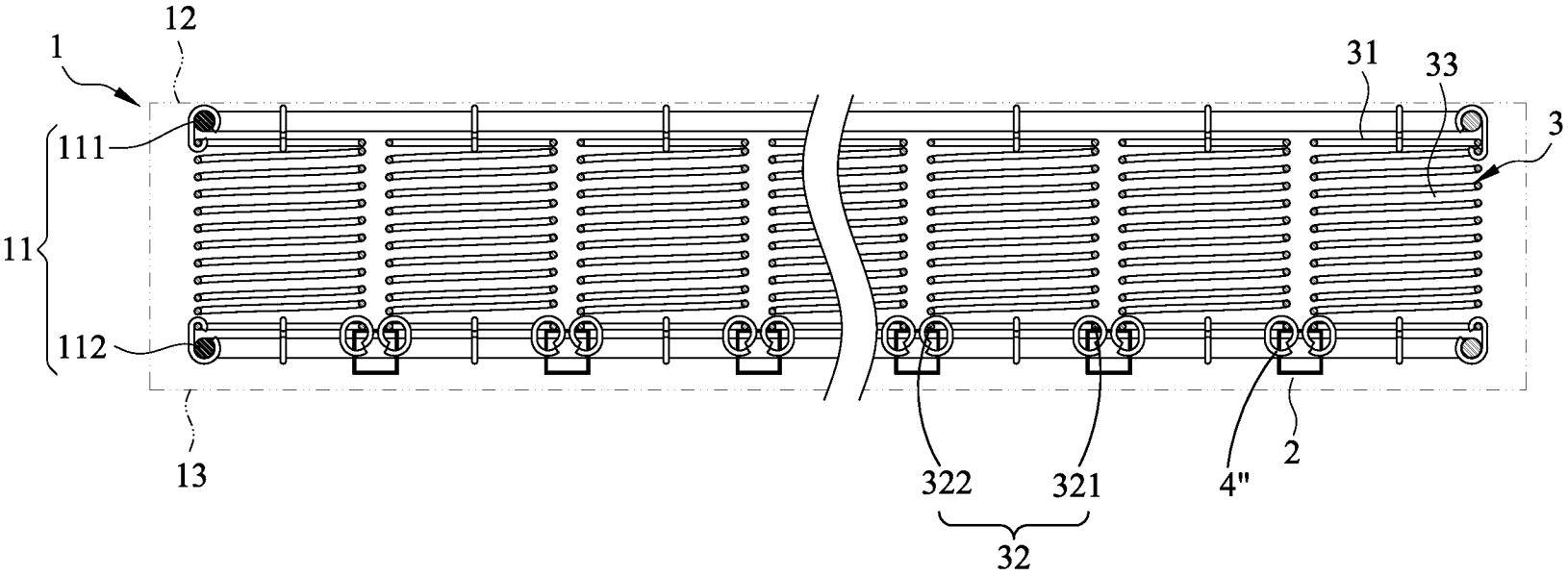
FIG. 6 is a sectional view illustrating spring-loaded locating pieces in a spring mattress structure.

Referring to FIG. 6 which is a schematic view illustrating spring-loaded locating pieces in a further embodiment wherein the spring-loaded locating pieces 4" are C-shaped rings which are coupled with corresponding pinholes on the shaft levers 2 so that the first placement end 321 and the second placement end 322 of the spring 3 as well as the second stress surface 32 of the spring 3 are fixed on surfaces of two adjacent shaft levers 2.

Furthermore, both the first placement end 321 and the second placement end 322 of the spring 3, which is made of metal material as that of the shaft lever 2, as well as the second stress surface 32 of the spring 3 can be fixed on surfaces of two adjacent shaft levers 2 in a spot welding process.

As shown in FIG. 7, the springs 3 can be exteriorly covered with one layer of external coating 6 which is made of paper, woven or non-woven fabric, or another fabric material and penetrated by the first elastic fasteners 42 and the second elastic fasteners 43 of the spring-loaded locating pieces 4 before the first elastic fasteners 42 and the second elastic fasteners 43 are coupled with the springs 3; the second stress surfaces 32 of the springs 3 can be stuck on the shaft levers 2 with viscose which is taken as the spring-loaded locating pieces 4' permeating onto the second stress surfaces 32 of the springs 3 through the external coating 6; the spring-loaded locating pieces 4" which are manufactured as C-shaped rings can be coupled with the springs 3 by penetrating the external coating 6; the external coating 6 made of paper, woven or non-woven fabric, or another fabric material can be easily penetrated by the spring-loaded locating pieces 4, 4".

Moreover, the minor springs 5 can be covered with one layer of external coating 7 made of paper, woven or non-woven fabric, or another fabric material similarly without entanglement of one minor spring 5 and one spring 3, each of which is stretched or compressed.

What is claimed is:

1. A spring mattress structure, comprising:

a mattress body having a top bed surface and a bottom bed surface;

twelve rows of springs enclosed in the mattress body, wherein each row has nine springs;

wherein each of said springs has a hollow space, a first stress surface and a second stress surface located below the first stress surface;

wherein the second stress surface has a first placement end and a second placement end opposite the first placement end;

a rectangular top frame enclosed within the mattress body and directly connected to thirty eight of said springs;

a rectangular bottom frame enclosed within the mattress body and directly connected to thirty eight of said springs;

a plurality of shaft levers evenly spaced from each other and directly connected to said bottom frame, wherein each shaft lever extends for a first distance vertically above the bottom frame and a for a second distance vertically below the bottom frame, the second distance being approximately equal to a height of the bottom frame and being substantially greater than the first distance;

wherein each of the springs is directly coupled, at at least one of the placement ends thereof, to an upper surface of at least one shaft lever, and wherein each of the springs is coiled into a cylindrical shape having a constant diameter throughout an entire length of the spring from an uppermost end to a lowermost end of said spring.

* * * * *